US006660978B1

(12) United States Patent
Avdeev et al.

(10) Patent No.: US 6,660,978 B1
(45) Date of Patent: Dec. 9, 2003

(54) ELECTRICALLY CONDUCTING TEXTILE AND THE METHOD FOR REALIZING THE SAME

(75) Inventors: Oleg Valerievich Avdeev, Saint-Petersburg (RU); Tatiana Nikolayevna Genusova, Saint-Petersburg (RU); Vladimir Igorevitch Rumyantsev, Saint-Petersburg (RU)

(73) Assignee: 3C-Carbon and Ceramic Company B.V., Vucht (NL)

( * ) Notice: Subject to any disclaimer, the term of this patent is extended or adjusted under 35 U.S.C. 154(b) by 0 days.

(21) Appl. No.: 09/980,984

(22) PCT Filed: May 1, 2000

(86) PCT No.: PCT/NL00/00282

§ 371 (c)(1),
(2), (4) Date: Mar. 13, 2002

(87) PCT Pub. No.: WO00/67528

PCT Pub. Date: Nov. 9, 2000

(30) Foreign Application Priority Data

Apr. 29, 1999 (RU) ..... 99109276

(51) Int. Cl.[7] ..... H05B 3/14

(52) U.S. Cl. ..... 219/549; 219/548; 219/553; 338/210; 427/228; 427/122

(58) Field of Search ..... 219/549, 548, 219/553, 545; 338/210; 252/502, 510, 511, 518.1; 524/62, 79, 494; 427/249.1, 249.3, 255.11, 255.14, 255.6, 314, 316, 122, 228; 264/29.1, 29.4

(56) References Cited

U.S. PATENT DOCUMENTS 3,949,106 A 4/1976 Araki et al.
4,510,077 A 4/1985 Elton
4,752,504 A * 6/1988 Rickborn ..... 427/249
4,825,049 A 4/1989 Rickborn
4,895,082 A 1/1990 Mindermann et al.
5,256,177 A * 10/1993 Bennett ..... 65/3.11
5,373,046 A * 12/1994 Okamura et al. ..... 524/413
5,891,518 A * 4/1999 Acevedo et al. ..... 427/228

FOREIGN PATENT DOCUMENTS

JP 10068514 3/1998
JP 11094227 4/1999

* cited by examiner

*Primary Examiner*—Teresa Walberg
*Assistant Examiner*—Shawntina T. Fuqua
(74) *Attorney, Agent, or Firm*—Handal & Morofsky

(57) ABSTRACT

The invention pertains to the electrothermal field and in particular to the resistive heating elements on the basis of the glass-fibre textile with the pyrocarbon coating and may be used for the production of the heating elements in heaters for both industrial and domestic applications. For obtaining the electrically conducting textile with the wide range of resistance and for broadening its sphere of application, as well as lowering the deposition temperature and retaining low scattering of the resistance along the whole field of the textile, the said textile contains 0.2–15% weight of pyrocarbon of turbostrate structure with hydrogen content up to 2% weight and with density of 0.8–1.5 g/cm$^3$, and 86.0–99.8% weight of glass-fibre textile with the softening temperature at least 650° C. The raw hydrocarbon materials used for pyrocarbon production are hydrocarbon oils with the viscosity of 8 to 23 sSt, which are preliminarily heated to 350–450° C. and in the flow of the inert gas are put through the nozzle with the developed surface at the temperature of 450–500° C., while the deposition of the pyrocarbon out of the chemical vapour is effected at 600–800° C. with the subsequent degassing of the obtained textile at 350–450° C. in the vacuum.

10 Claims, 3 Drawing Sheets

ELECTRICALLY CONDUCTING TEXTILE AND THE METHOD FOR REALIZING THE SAME

TECHNICAL FIELD

The invention relates to the electrothermal field, and in particular to resistive heating elements based on a glass-fibre textile with a pyrocarbon coating and may be used for the production of heating elements in heaters for both industrial and domestic applications.

Russian Patent No. 2018492, 1992 discloses the electrically conducting materials on the basis of woven siliceous or quartz monofilaments with pyrocarbon coatings. Said coating has a width of 2 to 200 nm, and Russian Patent No. 2100914, 1996 discloses the same with a coating of pyrocarbon on the laminated structure.

However in order to obtain the known electrically conducting materials only the highly siliceous or quartz filaments with high softening temperatures could be used. This limits significantly the areas of application for the known materials as heating elements due to their high cost.

U.S. Pat. No. 4,825,049, 1989 discloses an electrically conducting textile consisting of glass-fibre with a pyrolytic carbon coating containing at least 70% of carbon, obtained via pyrolysis of hydrocarbons at temperatures of 800 to 1200° C., with the following ratio of the components, % weight:

| | |
|---|---|
| Pyrolytic carbon coating | 0.001–17.0 |
| Glass-fibre textile | 83.0–99.999 |

The known electrically conducting cloth has a resistance of 0.1 to 1000 Ohm/cm$^2$.

Among the disadvantages of the known textile the following could be named: the impossibility of increasing its resistance above 1000 Ohms, which limits its field of application. Besides, the necessity to use the glass-fibre textile with softening temperature over 800° C. because of the high pyrolysis temperature also limits its field of application in various heaters because of is high cost.

Russian Patent No. 2018492, 37/00, 1992 discloses a method of production of electrically conducting materials on the basis of siliceous and quartz filaments coated with pyrocarbon layer involving the deposition of pyrocarbon out of the chemical vapor, achieved at temperature of 800 to 1000° C. out of natural gas.

Russian Patent No. 2100914, 1996 discloses a method of production of electrically conducting elements on the basis of siliceous or quartz monofilaments covered with a layer of pyrocarbon of laminated structure, involving the supply of a hydrocarbon raw material, e.g.—deoxidized white-spirit or kerosene in a flow of inert gas, nitrogen and glass filaments into the reactor with the subsequent deposition of the pyrocarbon out of the chemical vapour to the filaments' surface at the temperature of 100–1100° C.

SUMMARY OF THE INVENTION

The disadvantage of the known methods is the high temperature of the pyrocarbon deposition which results in impossibility of using the glass filaments with low softening temperatures in the production of electrically conducting textiles.

The purpose of the present invention is to obtain the electrically conducting textile with the wide range of resistance as d broadening its field of application at the heating element, as well as the lowering of the temperature of the pyrocarbon deposition in order to increase the range of the glass-fibre textiles used for its production while retaining the low resistance scatter along the whole field.

The purpose is attained via the following: the known electrically conducting textile consisting of glass-fibre textile with the pyrolytic carbon coating is modified to contain a glass-fibre textile with a softening temperature not less than 640° C. and with the pyrocarbon having a paracrystalline structure with a density of 0.9–1.5 g/cm$^3$, containing up to 2% weight of hydrogen with the following components ration, % weight:

| | |
|---|---|
| Pyrocarbon of turbostrate structure | 0.2–15.0 |
| Glass-fibre textile with softening temperature at least 650° C. | 85.0–99.8 |

Besides, the electrically conducting cloth may additionally contain the protective polymer coating.

The purpose is also attained via the following: the known method of producing the electrically conducting textile on the basis of the glass filaments coated with the pyrocarbon layer, involving the supply of the raw hydrocarbon material into the reactor in the flow of the inert gas and the subsequent deposition of pyrocarbon out of the chemical vapor in the filaments' surface at high temperature, is modified so that the raw hydrocarbon material used comprises hydrocarbon oils with a viscosity of 5 to 23 cSt, (centistones) which are preliminarily heated to 350–450° C. and in the flow of the inert gas are put through the nozzle with the developed surface at the temperature of 450–550° C., while the deposition of the pyrocarbon out of the chemical vapour is effected at 600–800° C., on the surface of the glass-fibre with the softening temperature at least 640° C. with the subsequent treatment at 350–450° C. in the vacuum.

Besides, the industrial, motor, transformer and vacuum oils are used as oils, and as nozzle the macroporous silica, stainless steel shavings and non-organic filaments are used. It is wise to coat the obtained textile with the protective polymer layer, where the India rubber is used as polymer.

A main advantage of the proposed electrically conducting textile is that it could be produced with a wide range of resistance, namely 1 to 3000 Ohm/square, which allows it to be used as a heating element with a broad range of applications from industrial devices for chemical, pharmaceutical and food industry to household appliances and health care.

The stated result is achieved by including into the electrically conducting textile the glass-fibre textile with the softening temperature at least 650° C. and pyrocarbon of turbostrate structure with the above mentioned parameters as well as carrying out the deposition of the pyrocarbon at much lower temperatures of 600 to 800° C. and the technology of the oil preparation. Besides that, the above allows broadening the range of glass-fibre textiles used for its production and to widen the sphere of application for the electrically conducting cloth by making the heating elements with the wide range of electrical properties while retaining their uniformity at the whole field of the textile, simplifying simultaneously the production method in the economic sense by lowering the pyrocarbon deposition temperature.

The proposed electrically conducting textile has a uniform coating of paracrystalline or turbostrate pyrocarbon on each filament which is achieved by the proposed coating technology. The above excludes the possibility of the stratification of the pyrocarbon coating and provides the uniformity of the electrical properties along the whole field of textile because the scattering of the electrical resistance along the length and across the width is within 7–10%. The claimed ration of the components in the electrically conducting textile provides the wide range of the resistance with which it could be produced.

DETAILED DESCRIPTION OF THE INVENTION

Figure 1:
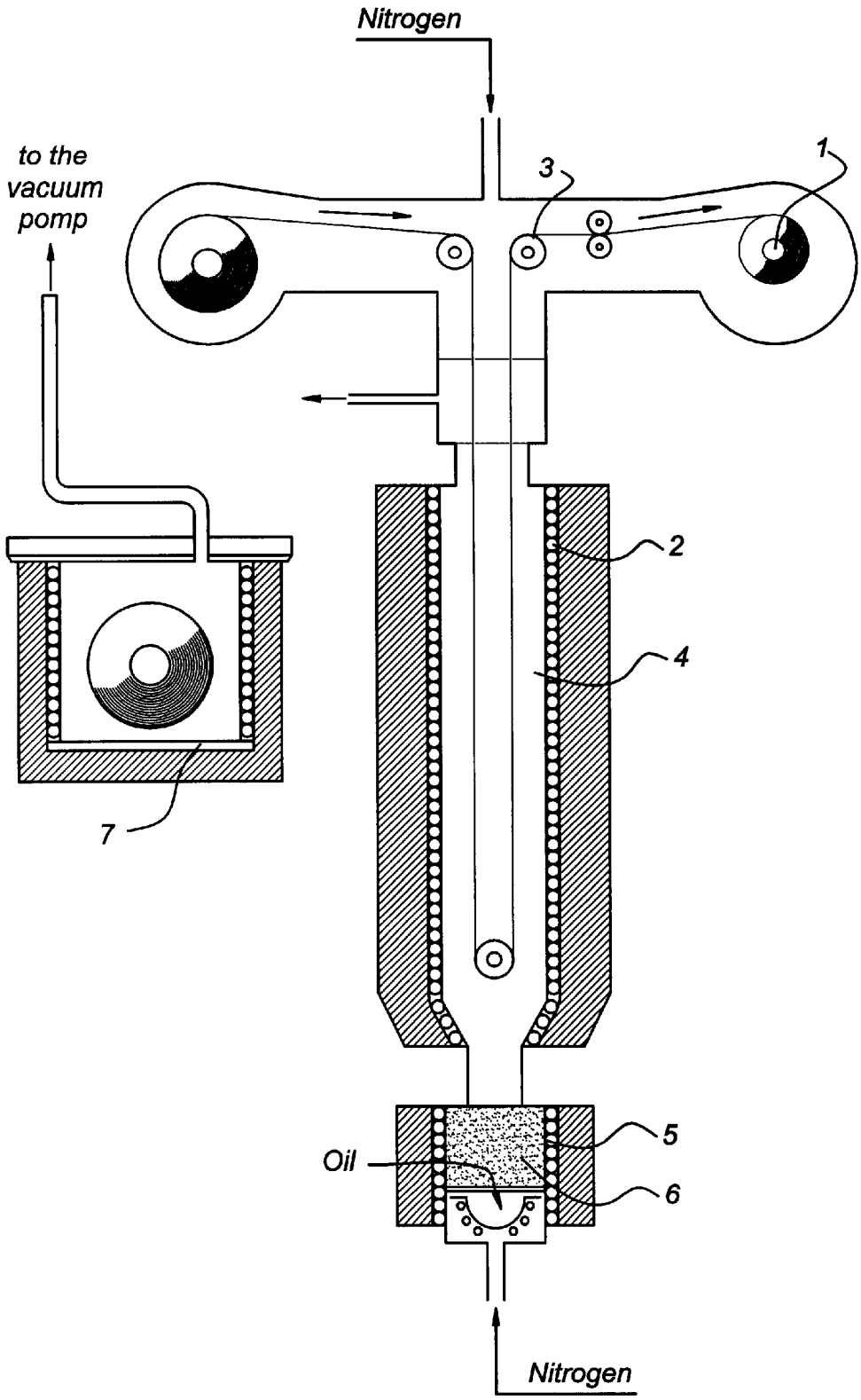
FIG. 1 is an overall view of the electrically conducting textile production plant.

Referring to FIG. 1, the plant includes the drums 1, rector oven 2, tape pulling mechanism 3, deposition zone 4, gasificator 5, nozzle 6 and vacuum oven 7.

An electrically conducting textile is proposed, containing glass-fibre textile with a softening temperature at least 640° C. with the coating of pyrocarbon of turbostrate structure having density of 0.9–1.5 g/cm$^3$, containing up to 2% weight of hydrogen with the following components, ratio, % weight.

| | |
|---|---|
| Pyrocarbon of turbostrate structure | 0.2–15.0 |
| Glass-fibre textile with softening temperature at least 650° C. | 85.0–99.8 |

Electrically conducting textile may have the protective coating of India rubber or other polymers.

As glass-fibre textile with the softening temperature at least 650° C. the proposed textile may contain the glass-fibre textile of aluminum-borosilicate filament (GOST 19906-83, GOST 19170-73), of magnesium-aluminosilicate filaments of KJIIII-TO (TY 6-11-238-77), KT-11-TO (TY 6-48-64-91), KT-600II (TY 6-48-64-91), KJIIII-290 and other brands.

As the polymer protective coating the India rubber coating of SKTN (GOST 13 835-73), SKTN-Med (TY 38.103.572-84), of copolymer "SMIROSIL" (TY 38.103.454-79) and of Kreol compound (TY 38.303-04.1-10-95) could be used.

The electrically conducting textile is produced in the following way.

The roll of glass-fibre textile is place into the drum 1 and pulled through the reactor oven 2 by means of tape-puling mechanism 3 at the speed, which provides the 0.5 to 5.0 hours' residence of the glass-fibre textile in the zone 4 of deposition of the reactor over 2.

The oil is supplied into the gasificator 5 of the reactor oven 2, which is heated up to 350–450° C. The vacuum oil BM-4 (TY-38401-583-90), industrial oils I-20A and I-20 (GOST 20799-88), motor oils M8B$_2$, M18G$_2$ etc. (GOST 8581-78), transformer oils (GOST 982-80), straw oil GOST 1666-80 etc., as well as wasted oils could be used as hydrocarbon oil.

The oil vapours generated in gasificator 5 of the reactor oven 2 along with the carrier gas nitrogen pass through the nozzle 6 of the gasificator are heated to 450–500° C. and are supplied to the deposition zone 4 of the reactor oven 2. The macroporous silica KSMG (GOST 39-56-76), stainless steel shavings and non-organic silicon carbide filaments (TY 6-02-1183-79) are used as nozzle. In the zone 4 of the reactor oven 2 the deposition of the pyrocarbon with the above stated parameters is carried out at 600–800° C.

At the outlet of the reactor oven 2 the coated glass-fibre textile is rolled on the drum 1 of the tape pulling mechanism 3, and then the obtained textile roll is loaded into the vacuum oven 7 and undergoes degassing at 350–450° C. during 1 hour. After cooling the obtained electrically conducting textile is covered with the protective polymer layer of up to 0.3 $\mu$m.

Below are the examples of producing the proposed electrically conducting textile.

EXAMPLE 1

On the drum 1 of the tape-pulling mechanism 3 a roll of aluminoborosilicate glass-fibre textile with the softening temperature of 650° C. is placed. The reactor oven 2 and the gasificator 5 are blown out with nitrogen and heated to 600° C. and 350° C. respectively. Then the transformer oil GOST 982-80 having a viscosity of 8 cSt is supplied into the gasificator, the vapors if the said oil passing though the nozzle 6 of silica heated to 450° C. are fed into the zone 4 of deposition of the reactor oven 2. In the zone 4 of the deposition occurs the pyrolysis of the oil vapors with the generation of the pyrocarbon of the turbostrate structure, which is deposited on the glass-fibre textile, pulled though the said zone 4 with the speed of 5 m/hour by means of the tape-pulling mechanism 3. The obtained glass-fibre textile with the pyrocarbon coating is rolled on the drum 1, the roll of the said textile is loaded then into the vacuum oven 7 and is degassed during 1 hour at 350° C. and then is cooled. The obtained electrically conducting textile has the following composition:

| | |
|---|---|
| Pyrocarbon of trubostrate structure with hydrogen content 0.2% of 2.0% and with density 0.9 g/cm$^3$ | |
| Glass-fibre textile | 99.8% |
| Resistance | 3000 Ohm/cm$^2$ |

The scattering of the resistance along the length and across the width of the textile equals 7±0.5%. The characteristics of the obtained electrically conducting textile described in this example as well as in all the subsequent examples are given in the Table 1. Table 2 show the characteristics of the materials used and the technological parameters of the textile production method.

EXAMPLES 2–5

Electrically conducting textile is obtained by the same method as set forth in Example 1 but with different technological parameters of production method and the initial glass-fibre textile is substituted with aluminoborosilicate textile T-11 (example 2), magnesiumaluminosilicate glass-fibre textile T-46 (BMII)—76 (example 3). siliceous textile KT-600II (example 4) and KJIIII-290 (example 5), as well as oils used are substituted with vacuum oil BM-4 (example 2), with industrial oil H-20A (example 3), with motor oil $M8B_2$ (examples 4, 5). The resistance scattering of the textile in all examples remains within 7±0.5.

EXAMPLES 6, 7

Electrically conducting textile is obtained as set forth in example 1, but the obtained textile is additionally covered with the protective layer of the low-molecular India rubber CKTH 0.2 mcm wide (ex maple 6) and "KREOL" compound 0.3 mcm wide 9 example 7). The resistance scattering of the textile in all examples remains within 7±0.5% in example 6 and within 8±0.5% in example 7.

EXAMPLES 8, 9

Electrically conducting textile is obtained as set forth in example 4, but as the nozzle the stainless steel shavings are used (example 8) or non-organic filaments of the silicon carbide whiskers (example 9). The resistance scattering of the textile in all examples remains within 9±0.5%.

In summary, development of the chemical fiber production technology accounts for the successful development of many technical fields and broad use of the new materials for domestic applications. This pertains as well to the wide range of conductive chemical fibers of the most diverse composition and usage possibilities.

Among these one should point out the carbon fibers, whose role in the development of the most advanced technical applications is not to be underestimated. Still, despite the diversity of properties and increasing scale of commercial production the price for this class of materials is rather high and prohibits their use in many domestic and technical fields of application.

The present invention presents the results of the development of the technology for production of the conductive textile by means of applying the pyrocarbon coating of pre-determined thickness upon each filament of the inexpensive commercially produced glass-fibre textiles.

The methods for deposition of the pyrolytic carbon out of the chemical vapor containing various hydrocarbons at atmospheric or lowered pressure upon different kinds of bases were actively studied since 1960-ies and continue to be studied until present.

The common disadvantage which hinders greatly the use of the materials obtained by chemical vapor deposition (CVD) is a way too high production cost which is due to the high energy-intensity of the process and use of expensive raw materials. This disadvantage may be mitigated by transition to the lower temperatures.

Still, the development of the production technology on the basis of such process could be a challenging task because of the complexity of the basic process and its sensitivity to the fluctuations of the basic parameters, such as deposition surface temperature, linear velocity of the gas stream, concentration of hydrocarbons, etc.

This fact accounts for the narrow range of the parameter values, exceeding which results in the considerable change in the properties of the obtained materials.

It is known that the velocity of formation of the single element of the thin pyrocarbon coating structure—monolayer of the hexagonal-bound carbon atoms is higher for olefines and aromatic hydrocarbons (pluribus impar) than that for linear low-molecular ones.

It has been proved empirically that the formation of the pyrolytic carbon coating using complex multi-component structure (e.g. oils) at temperatures as high as 600–650° C. occurs with the velocity which is enough for setting-up the continuous technological process for obtaining the conductive pyrocarbon layer upon the glass-fibre textile. Moreover, provided the specific set-up of the process and preparation system of reaction gas mixture one could deposit the pyrocarbon layer of the high precision-controlled submicrometer thickness upon each filament.

The plant for obtaining the pyrocarbon coating upon glass-fibre textiles comprises three-zone reactor oven, gasifier, dosage pump for liquid hydrocarbons' supply, tape-pulling mechanism with two drums for initial glass-fibre textile and for the final coated textile, temperature control system, and continuous textile surface resistance monitoring unit.

The chief difference of the suggested method for applying pyrocarbon coating lies in using the complex, multi-component systems, e.g. oils as the hydrocarbon raw material. Oil vapors are a mixture of unsaturated nafrene and aromatic hydrocarbons with the domination of the latter ones.

To stabilize the chemical vapor composition, meant for subsequent pyrolytic carbon deposition, oil vapors are preliminary directed through the heated catalyst nozzle with the developed surface, upon which the high-molecular hydrocarbons are decomposed, yielding the simpler components. Pyrocarbon is generated within the reactor, through which the glass-fibre textile is pulled by tape-pulling mechanism.

Thin pyrolytic carbon film is deposited upon each filament of the textile. The pyrocarbon layer thickness and composition determine the electrical resistance of the obtained textile. The specific electrical resistance measured by potentiometric method as resistance of the square fragment of the textile R (Ohm) is considered to be the chief parameter of the pyrocarbon. Generally it depends on the thickness of the coating, kind and density of the textile weave.

Pyrocarbon layer thickness is adjusted by adjusting the main technological parameters: deposition zone temperature, tape pulling velocity, gasifier temperature, oil supply rate surface area of the catalyst gasifier nozzle.

Multi-factor experiment planning methods allow taking into account the combined impact of various factors on the response function. The chief factors influencing the textile properties are: oil consumption ($G_0$), deposition temperature ($T_{dep}$) and gasifier temperature $T_g$. To these factors should be added the tape pulling speed and working surface area of the catalyst nozzle S. The last factor could only be adjusted before and not during the experiment, whereas the tape pulling speed at the present plant could only be adjusted in discreet steps from 2 to 14 m/hour. These factors are assumed to remain constant.

The specific conductivity of the textile C—the value, reverse for the resistance-to-weight gain ratio (per area textile) was selected as the response function.

The influence of the listed features non-linear character, so the second-order plane—orthogonal central compositional plane (OCCP), allowing for the separate estimation of the regression coefficients of all linear and square members as well as pair impacts was selected.

For the three-factor experiment (N=3) the $x_1$, $x_2$, $x_3$ factor fluctuation ranges were selected:

($x_1$) oil consumption $G_D$:5–55 ml/hour.

($x_2$) deposition temperature $T_{dep}$: 600–800° C.

($x_3$) preparation temperature $T_g$: 450–550° C.

For such experiments the specific conductivity logarithm—in C was selected as a response function.

Figure 2:
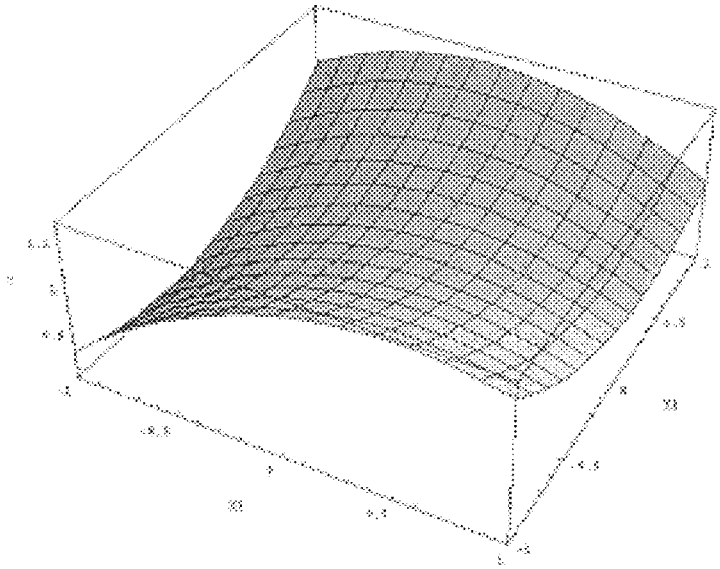
FIG. 2 is a C surface plot of parameters $x_1$ and $x_2$ against t for a given temperature and pulling velocity.

FIG. 2 in C surface for the preparation temperature $T_g$=540° C. and pulling velocity $V_p$=6 m/hour.

As it follows form the obtained results, there is a maximum oil consumption, above which the electrical conductivity of the coating drops. This is due to the existence of the threshold concentration of the hydrocarbons within the reaction zone, which, being exceeded, results in the domination of the soot-producing volumetric pyrolysis process over the surface process. As the temperature rises this threshold declines which is due to the significant heating of the reaction has and speeding-up of the pyrolysis process. As the temperature rises in the 600–700° C. range the electrical conductivity of the coating increases drastically (by three orders of magnitude) which is caused by the two factors: increase of the deposited amount of carbon and change in the chemical composition and structure of the coating. It is known that during the decomposition of hydrocarbons at 500–640° C. the remnants contain carbon and gumlike products comprising the condensed aromatic and naftenic hydrocarbons, partially non-hydrogenated. Further increase of temperature from 700 to 800° C. causes the slower decline of the electrical resistance (although the growth tempo of the deposited amount of carbon remains constant), which attests to the smaller contribution of the qualitative changes in the coating within the given temperature range. There is a minimum weight of the deposited carbon, which is required for the resistance to start declining, the said amount corresponding to the formation of the continuous film. The experimental figures for the deposited amount of the carbon and electrical resistance obtained for the textile of the similar weave, pluribus impar, are rather close on e to another which is explained by the close figures for the specific surface of these textiles (2–3 $cm^2/g$).

The developed mathematical model of the process of pyrocarbon film deposition upon the glass-fibre textile allows for obtaining the conductive pyrocarbon-coated glass-fibre textile with any pre-determined specific resistance within 5 to 2000 Ohm per square range.

The main features of the structural state of the low-temperature pyrocarbon films deposited by the above method upon the glass-fibre textile filaments at temperatures of 600–800° C. are:

Turbostrate (paracyrstalline) structure of the pyrolytic coating;

Presence of the considerable amount of technological impurities (accompanying chemical compounds).

The x-ray structural analysis of the coating material was done using the compact check-test pieces, obtained in the same reactor under the same conditions upon the flat bases of the analogous composition. The research was carried out by means of the x-ray diffractometer <<DRON-4>> (Russia) using the large-angle diffractometry method and $CuK_\alpha$-radiation. The results have shown that the pyrolytic carbon deposited under the above conditions is anisotropic and features only turbostrate structure—there are only extremely fuzzy /002/ and /004/ lines for the c-direction of the x-ray pattern. The pseudo-cristallite size is extremely small, $L_c$=7–10 A. These factors attest to the absence of three-dimensional ordering whereas the two-dimensional structure of the short-range order is already observed.

Figure 3:
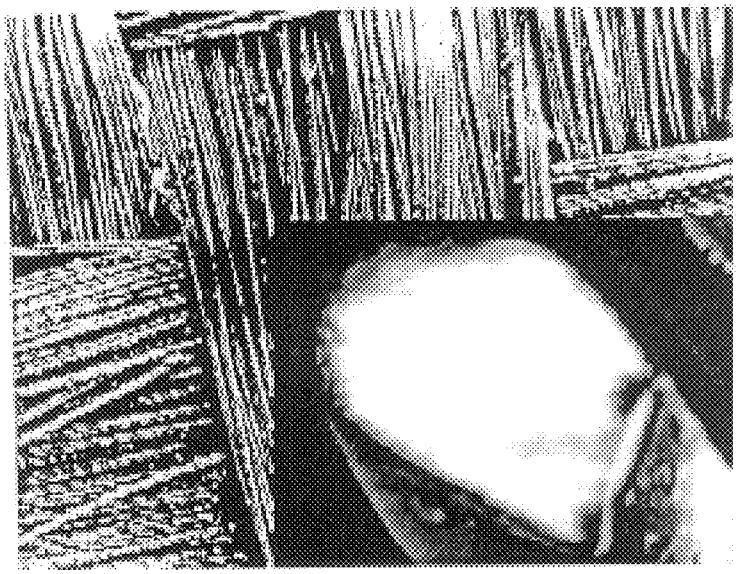
FIG. 3 is a two-component electron micrograph of a pyrocarbon-coated glass-fibre textile and a coated filament.

The electro-microscope research has shown that the conductivity of the textile with the specific resistance of 2000 to 5 Ohm is provided by the continuous pyrocarbon films having the thickness of 0.05 to 0.5 micrometers (FIG. 3).

FIG. 3*a*) Glass-fibre textile, pyrocarbon-coated at 700° C.

FIG. 3*b*) single filament with coating.

The composition of the pyrocarbon films being the component of the pyrocarbon-coated glass-fibre textile was studied using the IR-transmission-absorption spectroscopy method, which allow registering the smallest concentrations of impurities —about $10^{13}$–$10^{14}$ $l/cm^3$.

Since carbon is highly absorptive material in the IR spectrum area, the transmission spectrums of the thin (up to several micrometers) pyrocarbon films deposited on the IR-transparent bases were selected to be the chief analysis method.

The base made of undoped silicon, the said base featuring the practically stable transmission rate in the 1 micrometer—60 micrometer wave range allowed for getting the comprehensive picture of the absorption spectrum of the low-temperature pyrocarbon films (FIG. 3).

Figure 4:
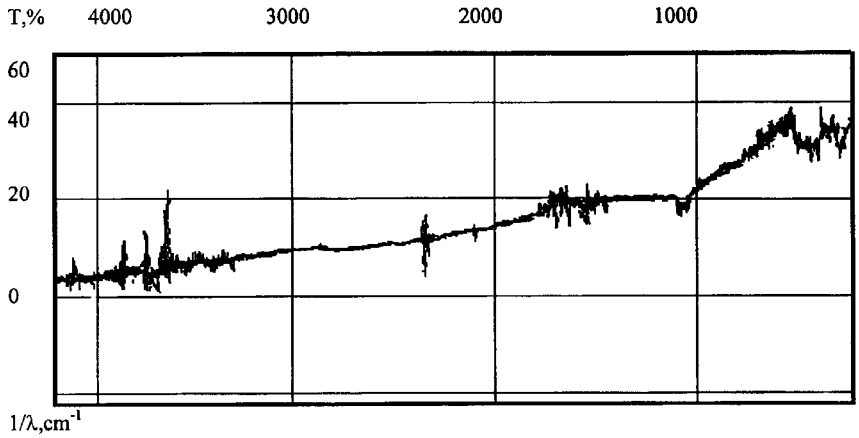
FIG. 4 is an IR transmission-absorption spectrum.

FIG. 4. The complete IR-transmission-absorption spectrum of the low-temperature pyrolytic carbon film deposited upon the silicon base.

The spectrum showed no distinct absorption bands, but there are both the absorption increase in the short-wave range (λ=2 micrometer), due to the inter-zone transitions, and absorption increase in the area of wave length over 10 micrometer, due to the free current carriers and through conductivity of the film.

In the high-frequency area of the spectrum there are registered only inter-zone transitions within the carbon itself. Simultaneously, the characteristic increase of the transmission into the long-wave area is observed for the pyrocarbon films within the entire spectrum range studied.

The weak bands observed in the 6–10 micrometer are of the absorption spectrums relate to the hydrocarbon bonds, but no bands in the 3 micrometer area were registered, the latter being responsible for the covalent bonds.

Thus the research resulted in the following conclusions:

The carbon concentration in the pyrocarbon films which are the basis of the pyrocarbon-coated glass-fibre textile is not less than 95%.

The C-H bonds of the low-temperature pyrocarbon films have more dipolar nature than those of hydrocarbons.

The above conclusions were confirmed by other physical and chemical research methods.

The testing of pyrocarbon-coated textile was fulfilled using X-ray photoelectron spectroscopy (ESCA—5400, PHI, USA) the mass-spectroscopy with laser desorption and ionization (TOF-1, Bruker, Germany). The obtained results are compared with spectra of standard pyrographite and fullerene.

The core Cls spectrum shows the presence of the phase of pyrographite like C-C bonds and also the presence of C-H and C-O bonds whose amount depends on the certain sample (see FIG. 5*a*). The energy position of main pyrographite-like component is 284.5 ev, that is similar to pyrographite (284.5 eV). The valency band spectra of pyrocarbon-coated textile show some pronounced features which energy position is similar to corresponding features in valance band of fullerene (see FIG. 5*b*) and the general view of valency band looks like the overlapping of valency bands of pyrographite and fullerene. Thus the XPS results make it possible to propose the presence of pyrographite and fullerene like structures and their compositions with hydrogen and oxygen.

Figure 6:
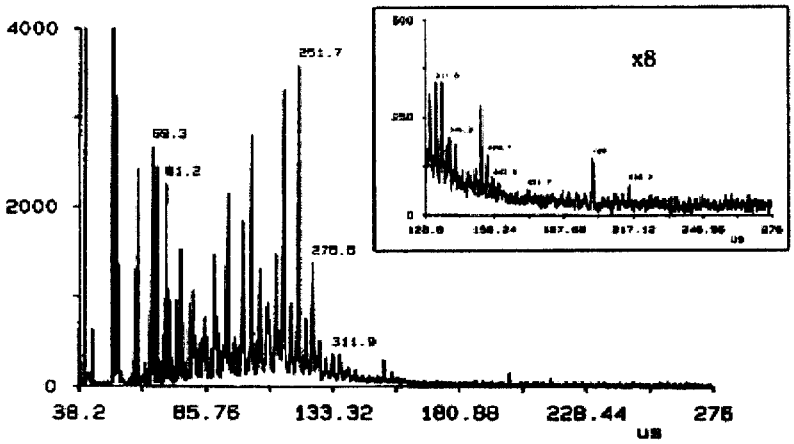
FIG. 6 shows a laser desorption spectrum of pyrocarbon-coated textile.

The typical mass-spectrum of laser ablation products of the samples is shown on FIG. 6. The major peaks correspond to the carbon structures in the range of 40–360 a.e.m. and their hydrogenated compounds. The fullerene's peaks (C60 and C70) with weak intensity also present on mass-spectra of pyrocarbon-coated textile. The relative intensities of peaks depend on the temperature of sample manufacturing. The higher temperature of the more fullerenes and less hydrogenated carbon ions.

Thus the obtained results permit us to propose that carbon coating contain pyrographite matrix and hydrogenated carbons compounds and also small amount of fullerene itself. No evidence of oil contamination was observed.

Figure 5:
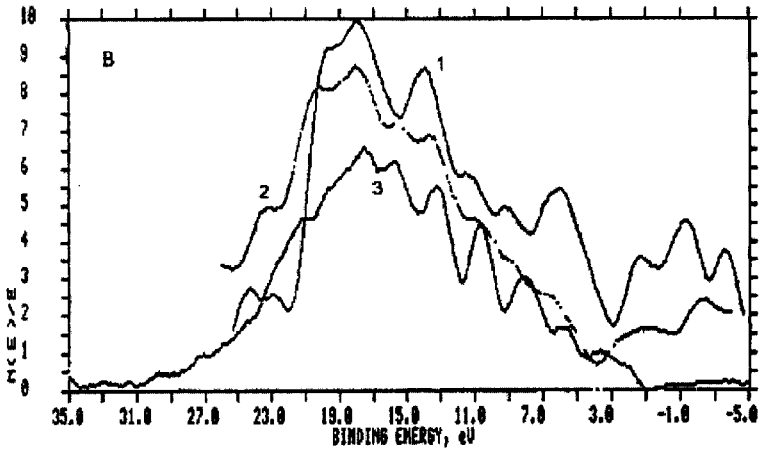
FIG. 5 shows X-ray photoelectron spectra of pyrocarbon coated textile and pyrographite.

FIG. 5: X-Ray photoelectron spectra of pyrocarbon-coated textile sample A) Core Cls spectra of pyrocarbon-coated textile-1, and pyrographite-2, B) Valency band spectra of pyrocarbon-coated textile-1, pyrographite-2, fullerene-3.

FIG. 6 Laser desorption mass-spectrum of pyrocarbon-coated textile.

According to the classification suggested by R. M. Levit the conductive fiber obtained by the above method belongs to the heterogeneous fibers, whose conductivity is ensured by means of surface coating. At the same time the obtained conductive textile meets all the strict requirements set for this class of the materials:

Low density

High physical and mechanical properties

Possibility for varying the electro-physical parameters within a broad range.

The above qualities allow for using this material for various applications including a wide scope of electrical heating elements.

As an example of the possible application, several kinds of heating elements based on this textile were developed and lab- and field-tested.

Thin flexible heating elements with the combined electrical insulation coating made of silicon sealant and polyamide film. Such heaters are designed for heating containers, pipelines with viscous liquids, chemical and medical devices, construction patterns, etc. Temperature limit 220° C. and maximum specific power 5 kW/m$^2$ are due to the insulation stability range.

Rigid heating elements with the operating temperature up to 300° C., which provides thermal stability during the heating of the composite insulating coating. The patterns for heating large-size tanks and devices are assembled on the basis of these heaters.

Besides the above, a group of heating devices was developed and tested, which operates at extra-low safe voltage: heating floors, clothing, car set covers, etc.

The testing of these heating elements have shown their capability for operation during at least 20,000 hours without any change of electro-physical parameters.

TABLE 1

The characteristics of the obtained electrically conducting textile

| | % Weight | | Pyrocarbon | | | |
|---|---|---|---|---|---|---|
| Item # | Pyrocarbon | Glass fibre textile | Hydrocarbon content, % weight | Density, g/cm$^3$ | Pyrocarbon layer thickness, mcm | Resistance, Ohm/cm$^2$ |
| 1. | 0.5 | 99.5 | 2.0 | 0.9 | 0.1 | 3000 |
| 2. | 2.5 | 97.5 | 1.3 | 1.0 | 0.3 | 1520 |
| 3. | 2 | 98 | 0.6 | 1.2 | 0.25 | 34 |
| 4. | 15.0 | 85 | 0 | 1.5 | 0.5 | 1 |
| 5. | 4 | 96 | 0.5 | 1.4 | 0.4 | 7 |
| 6. | 0.5 | 99.5 | 2.0 | 0.9 | 0.15 | 750 |
| 7. | 0.5 | 99.5 | 2.0 | 0.9 | 0.15 | 750 |
| 8. | 7.7 | 92.3 | 0 | 1.3 | 0.4 | 10 |
| 9. | 7.7 | 92.3 | 0 | 1.3 | 0.4 | 10 |

TABLE 2

Characteristics of the materials used and technological parameters of production method

| Item # | Softening temperature of glass fibre textile, ° C. | Oil viscosity, sSt | Gasificator temperature, ° C. | Nozzle temperature, ° C. | Deposition temperature, ° C. | Residence in deposition zone, hour | Pulling speed of the glass fibre textile, m/hour | Degassing temperature, ° C. |
|---|---|---|---|---|---|---|---|---|
| 1. | 650 | 8 | 350 | 450 | 600 | 1 | 5 | 350 |
| 2. | 650 | 8–11 | 350 | 450 | 600 | 5 | 1 | 450 |
| 3. | 850 | 17–23 | 400 | 500 | 700 | 0.5 | 10 | 450 |
| 4. | >1000 | 8–11 | 450 | 550 | 800 | 4 | 1.25 | 350 |
| 5. | >1000 | 8–11 | 450 | 550 | 750 | 1 | 5 | 400 |
| 6. | 650 | 5 | 350 | 450 | 600 | 1 | 5 | 350 |
| 7. | 650 | 8 | 350 | 450 | 600 | 1 | 5 | 350 |
| 8. | >1000 | 8–11 | 450 | 550 | 700 | 1 | 5 | 350 |
| 9. | >1000 | 8–11 | 450 | 550 | 700 | 1 | 5 | 350 |

What is claimed is:

1. Electrically conducting textile consisting of (a) a glass-fibre textile having a softening temperature of at least 650° C., the glass fibre textile being coated with (b) a pyrocarbon, said pyrocarbon having a paracrystalline structure, a hydrogen content up to 2% by weight and a density of 0.9 to 1.5 g/cm$^3$, wherein (a) and (b) are present within a ratio of 85.0 to 99.8 percent by weight and 0.2 to 15.0 percent by weight, respectively.

2. Electrically conductive textile according to claim 1, wherein the electrically conductive textile has an additional protective polymer coating.

3. Method for producing an electrically conducting textile consisting of a glass-fibre textile with a pyrolytic carbon coating according to claim 1, wherein:

(a) a mixture of a raw hydrocarbon material and an inert gas is preheated to 350° C. to 450° C., said raw hydrocarbon material being a hydrocarbon oil having a viscosity of 5 to 23 cSt, and being formed into a vapour and gas mixture, (b) said vapour and gas mixture is supplied to a reactor through a nozzle having a temperature of 450° to 550° and is formed into a reaction gas mixture, (c) a pyrocarbon is formed form the reaction gas mixture at a temperature of 600° to 800° C. and is deposited on the glass-fibre thereby forming a pyrocarbon coated glass-fibre textile, and (d) the pyrocarbon coated glass-fibre textile is degassed in vacuum at a temperature of 350° to 450° C.

4. Method according to claim 3, wherein the raw hydrocarbon material is selected from the group consisting of industrial oils, motor oils, transformer oils, vacuum oils, straw oils or the wastes thereof.

5. Method according to claim 3, wherein the nozzle comprises macroporous silica, stainless steel shavings or non-organic filaments.

6. Method according to claim 3, wherein the pyrocarbon coated glass-fibre textile is coated with a protective polymer layer.

7. Method according to claim 4, wherein the nozzle comprises macroporous silica, stainless steel shavings or non-organic filaments.

8. Method according to claim 4, wherein the pyrocarbon coated glass-fibre textile is coated with a protective polymer layer.

9. Method according to claim 5, wherein the pyrocarbon coated glass-fibre textile is coated with a protective polymer layer.

10. Method according to claim 7, wherein the pyrocarbon coated glass-fibre textile is coated with a protective polymer layer.

* * * * *